US008230706B1

(12) United States Patent
Amo

(10) Patent No.: US 8,230,706 B1
(45) Date of Patent: Jul. 31, 2012

(54) HANDCUFF COUPLING ASSEMBLY

(76) Inventor: Paul Amo, Summerfield, FL (US)

( * ) Notice: Subject to any disclaimer, the term of this patent is extended or adjusted under 35 U.S.C. 154(b) by 0 days.

(21) Appl. No.: 13/118,055

(22) Filed: May 27, 2011

(51) Int. Cl.
*E05B 75/00* (2006.01)

(52) U.S. Cl. ..... 70/16; 70/15; 70/17

(58) Field of Classification Search ..... 70/15, 16, 70/17; 119/778; 128/79
See application file for complete search history.

(56) References Cited

U.S. PATENT DOCUMENTS

| | | | | |
|---|---|---|---|---|
| 372,510 | A | 11/1887 | Bean | |
| 1,342,334 | A * | 6/1920 | Kruger | 70/16 |
| 1,456,846 | A | 5/1923 | Gamwell | |
| 1,572,262 | A | 2/1926 | Abbenzeller | |
| 1,579,333 | A | 4/1926 | Neal | |
| 1,900,242 | A | 3/1933 | Latou | |
| 2,388,766 | A | 11/1945 | Ruttiman | |
| 2,966,787 | A | 1/1956 | Tompkins | |
| 2,759,349 | A | 8/1956 | McKee | |
| 3,423,871 | A | 1/1969 | Foley | |
| 3,618,345 | A | 11/1971 | Smith | |
| 4,138,867 | A | 2/1979 | Tompkins | |
| 4,287,731 | A | 9/1981 | Kruger | |
| 4,300,368 | A | 11/1981 | Sullivan | |
| 4,314,466 | A | 2/1982 | Harris | |
| 4,574,600 | A | 3/1986 | Moffett | |
| 4,694,666 | A | 9/1987 | Bellingham et al. | |
| 4,697,441 | A | 10/1987 | Allen | |
| 4,840,048 | A | 6/1989 | Elam | |
| 5,205,142 | A | 4/1993 | Kruger et al. | |
| 5,461,890 | A | 10/1995 | Le Favor | |
| 5,526,658 | A | 6/1996 | Cross et al. | |
| 5,598,723 | A | 2/1997 | Ecker et al. | |
| 5,613,381 | A | 3/1997 | Savage | |
| 5,687,593 | A | 11/1997 | Cross | |
| 5,697,231 | A | 12/1997 | Tobin, Jr. | |
| 5,797,284 | A | 8/1998 | Lurie | |
| 6,026,661 | A | 2/2000 | Spiropoulos | |
| 6,311,529 | B1 | 11/2001 | Kang | |
| 6,349,574 | B1 | 2/2002 | Lurie | |
| 6,588,240 | B2 * | 7/2003 | Anderson | 70/16 |
| 6,684,666 | B1 * | 2/2004 | Taper | 70/16 |
| 6,886,375 | B2 * | 5/2005 | Amo | 70/16 |
| 2002/0189302 | A1 | 12/2002 | Anderson | |
| 2005/0097929 | A1 * | 5/2005 | Anderson | 70/16 |

FOREIGN PATENT DOCUMENTS

| | | | |
|---|---|---|---|
| GB | 2268778 | A | 1/1994 |

* cited by examiner

*Primary Examiner* — Suzanne Barrett
*Assistant Examiner* — David E Sosnowski
(74) *Attorney, Agent, or Firm* — Massinger Law Offices

(57) ABSTRACT

A coupling assembly for coupling a first handcuff bracelet and a second handcuff bracelet together, each bracelet including a locking mechanism for opening and closing the bracelet, the coupling assembly comprising: a swivel assembly for permitting angular rotation of at least one of the bracelets in a predetermined first rotational direction relative to a longitudinal axis extending through the swivel assembly and the first and second bracelets, the swivel assembly preventing the bracelets from being rotated in a second rotational direction opposite from said first rotational direction.

20 Claims, 10 Drawing Sheets

HANDCUFF COUPLING ASSEMBLY

FIELD OF THE INVENTION

This invention relates to the field of prisoner restraint generally and more specifically to handcuffs including an articulating and rotatable coupling assembly disposed between a pair of handcuff bracelets, the coupling assembly enhancing the functionality of the restraint apparatus.

BACKGROUND OF THE INVENTION

Handcuffs have been repletely known for well over a hundred years in the field of law enforcement as used in the incarceration of criminals and criminal suspects. Standard handcuffs, such as those that are described in U.S. Pat. No. 6,311,529, include a pair of lockable cuff or bracelet sections, each of the bracelet sections being defined by respective arcuate cheek and jaw members that are pivotally secured by means of a locking mechanism that is carried on the cheek member. The locking mechanism includes one or more gears that are engageable with a row of teeth carried by the pivotal jaw member, wherein the locking mechanism can be selectively disengaged and the bracelet sections opened by means of a key.

A number of significant developments have taken place over time to incorporate new and varied forms of locking mechanisms into the bracelet sections of the handcuffs, but very few developments have been made with regard to the interconnection between the bracelet sections. Typically, the lockable bracelet sections are tethered together by a linkage consisting of several chain links fixedly attached to the end of each bracelet section.

A number of ways have been developed for defeating or minimizing the effective use of handcuffs, once attached to a suspect, due in part to the above linkage. For example, in those instances where a person has the handcuffs attached behind their back, the present interconnection between the bracelet sections is sufficiently flexible to permit a cuffed individual to "step through" the handcuffs by pulling the handcuffs behind their legs, which can be accomplished, for example, when the detained individual is seated in a police vehicle. Once the handcuffs are in front of the individual, it is much easier for the detained individual to run or to achieve better balance. Moreover, the individual would also be able to better access a shirt pocket, for example, to retrieve a hidden handcuff key, to obtain a weapon or to hide evidence. Though restrained to some extent, it is also possible for a handcuffed individual to still use his or her hands to grab an officer, such as from behind when the officer has his or her back turned from the suspect or to attempt to grab an officer's sidearm by making contact with the officer, given the relative amount of freedom of the arms and hands that are provided using present handcuffs. There have also been numerous court cases that have involved handcuffs which have been made by detainees, due in part to the discomfort and injury stemming from their use. Some of these cases have resulted in significant monetary awards.

As noted above, there have been a few improvements developed in the linkage between the lockable bracelet sections, such as described, for example, by a restraint mechanism that is shown and described in U.S. Pat. No. 6,026,661 to Spiropoulos. According to this patent, a spool/reel system is introduced between the bracelet sections in a separate housing assembly. This system permits the spacing between the bracelet sections to be selectively adjusted as needed, much like a leash. This design, however, does not address the problems of "step through" as noted above and further enlists an entirely new mechanism that is likely to be incompatible with existing handcuffs without requiring significant redesign.

According to another developed technique, the chain linkage is replaced with a hinged interconnection between the bracelet sections. This design is repletely described in U.S. Pat. Nos. 2,966,787 and 4,138,867, each to Tompkins, U.S. Pat. No. 4,300,368 to Sullivan, U.S. Pat. No. 5,205,142 to Kruger et al., U.S. Pat. No. 5,461,890 to LeFavor, U.S. Pat. No. 5,526,658 to Cross et al., U.S. Pat. No. 5,598,723 to Ecker et al and U.S. Patent Publication No. 2002/0189302A1 to Anderson. In each of these references, the lockable bracelet sections are interconnected by a hinge assembly in which the hinging axis is arranged in a direction that is essentially perpendicular to the pivot axis of the bracelet sections. This hinging assists in the foldability of the handcuffs, but is not particularly effective in solving the above stated problems related to more effectively restraining a cuffed individual.

According to yet another improvement design, as described in U.S. Pat. No. 5,697,231 to Tobin, Jr., a pair of handcuffs are defined by respective bracelet sections that are attached to one another through a linkage assembly that includes at least one swiveling pin. This connection provides some flexibility in that three degrees of freedom are defined for an improved movement capability of the bracelet sections, but this flexibility in and of itself also does not adequately address or solve the problems that are discussed above.

SUMMARY OF THE INVENTION

It is therefore a primary object of the present invention to overcome the above-noted deficiencies of the prior art.

It is another primary object of the present invention to provide a set of handcuffs that can be more effectively used than those that are presently available.

It is yet another primary object of the present invention to create a coupling mechanism between the two bracelet sections of a set of handcuffs, wherein the coupling mechanism permits unidirectional rotation of the bracelet sections relative to one another in order to more effectively restrain a suspect and without significant modification or training for the user being required.

Therefore and according to a preferred aspect of the present invention, there is provided a set of handcuffs comprising: a first bracelet and a second bracelet, each openable and incrementally sizable, each of said bracelets including a locking mechanism for opening and closing the bracelet; and a coupling assembly for coupling the bracelet sections together, the coupling assembly including a swivel assembly mounted to the first bracelet for permitting angular rotation of at least one of the first bracelet and the second bracelet in a predetermined first rotational direction relative to a longitudinal axis extending through the swivel assembly and the first and second bracelets, the swivel assembly preventing the at least one first bracelet and the second bracelet from being rotated in a second rotational direction opposite from the first rotational direction.

According to another preferred aspect of the present invention, there is provided a coupling assembly for coupling a first handcuff bracelet and a second handcuff bracelet together, each bracelet including a locking mechanism for opening and closing the bracelet, the coupling assembly comprising: a swivel assembly for permitting angular rotation of at least one of the bracelets in a predetermined first rotational direction relative to a longitudinal axis extending through the swivel assembly and the first and, second bracelets, the swivel assembly preventing the bracelets from being rotated in a second rotational direction opposite from said first rotational direction.

Two embodiments of the swivel assembly of the present invention are described herein. A first embodiment of the swivel assembly is generally comprised of a spring clutch mechanism which permits unrestricted rotation of each bracelet in a predetermined "free" rotational direction relative to the swivel assembly's axis of rotation, while prohibiting rotation in the opposite "locking" direction. In the locking direction, the outer surface of a helical spring component is caused to lockingly engage the interior surface of its housing when a first portion of the housing is caused to rotate in response to, angular rotation of at least one bracelet section in a predefined rotational direction relative to the axis of rotation. This engagement restricts further movement of the swivel assembly in the locking direction and therefore locks the bracelets, as secured to an individual, from returning to their original position until the bracelet sections are opened. The greater the force of rotation (i.e., the harder the detainee attempts to turn the bracelets in the first direction, the more tightly the spring engages the inner surface of the housing.

In a second embodiment, swivel assembly is again generally comprised of a wrap spring clutch mechanism which permits unrestricted rotation of each bracelet in a predetermined free rotational direction relative to the swivel assembly's axis of rotation, while prohibiting rotation in the opposite locking direction. However, in this embodiment, the inner surface of the helical spring component is caused to grip the outer surfaces of a pair of abutting hubs (which together resemble a shaft) when at least one hub is caused to rotate in response to angular rotation of its corresponding bracelet in the predefined locking direction relative to the axis of rotation. This grip restricts further movement of the swivel assembly in the first direction and therefore locks the bracelet sections, as secured to an individual, from returning to their original position until the bracelet sections are opened. Here again, the greater the force of rotation (i.e., the harder the detainee attempts to turn the bracelets in the first direction, the more tightly the spring grips the hubs.

In both embodiments, the resulting movement caused by the rotation of the bracelet section about the axis of rotation causes the arms of a detainee to be rotated relative to one another and placing the arms from a vertical to a horizontal attitude with the arms crossing one another, depending on the amount of rotation applied. Once the arms have been placed in this position, they cannot be returned to their original position, or to any intermediate position therebetween, against the restraint mechanism. Additional movement of the bracelet section in the original rotational direction is still possible, but due to the restraint of the arms, the bracelet sections cannot be restored to their original position without opening the bracelet locking mechanism.

According to another preferred aspect of the present invention, there is disclosed a method of restraining an individual using a set of handcuffs, said method including the steps of: cuffing an individual using said handcuffs; and rotating one of the bracelet sections of said handcuffs to a predetermined angular position relative to the other of said bracelet sections about an axis in a first rotational direction, said handcuffs including a swivel assembly preventing said bracelet section from being rotated to an original or previous position in an opposite second rotational direction once aid bracelet section has been rotated to the predetermined angular position.

Preferably, the method includes the step of cuffing a person behind the back and then selectively rotating the arm of the detainee into a position that prevents step through. The restraint mechanism of the handcuffs thereby causes the bracelet section to be rotated to a predetermined angular position and locked therein. The method can also be performed by handcuffing a person with their arms in front and similarly rotating one of the bracelet sections or the arms to place the arms in a more secure position. The method includes rotation of the handcuffed arms to any one or more predetermined angular positions (e.g., 90.degree., 135.degree., 180.degree., etc).

An advantage of the present invention is that the present restraint mechanism does not significantly affect the overall design application of previously known handcuffs, including the bracelet locking mechanism.

Another advantage of the present invention is that provision of the herein described restraint mechanism does not alter the foldability of the handcuffs or otherwise restrict the handcuffs from fitting into conventional handcuff holders. Moreover, no new training is necessarily required for use.

The unidirectional locking feature of the present restraint mechanism offers a number of useful advantages. First, handcuffing a detainee behind the back using handcuffs having the above described restraint mechanism is much more secure than with previous systems, and is, in fact, actually more comfortable for the detainee.

An essential advantage provided by the handcuff restraint mechanism of the present invention is that "step-through" (that is, bringing the cuffed hands from the rear to the front of the detainee) is made virtually impossible.

Even when used on individuals that are cuffed from the front, the present restraint mechanism can be used to manipulate the arms of the suspect into a secure position, therefore making it much more difficult for the suspect to reach his or her pockets to retrieve a hidden handcuff key, to reach for a hidden weapon, or to get rid of evidence. As a result handcuffing, whether performed to the front or the back of the detainee, is made much more secure and effective. Moreover, proper use of the herein described restraint mechanism makes it literally impossible for a detainee to take an officer's weapon by contact therewith or to use his hands to grab an officer or others, especially from behind, by placing the arms around the officer's neck. As a result, law enforcement officers can feel much more confident and secure when handcuffing a subject in the front, making it easier to gain a subject's trust and cooperation.

These together with other advantages of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components, set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention. Such description makes reference to the annexed drawings wherein:

DETAILED DESCRIPTION OF THE PREFERRED EMBODIMENT

The following description relates to specific embodiments of a coupling assembly for a pair of handcuff bracelets, as well as a related method for using the described handcuffs in the detainment of an individual. It will be readily apparent to those of ordinary skill in the field from the discussion that follows, however, that there are variations of this mechanism that can accomplish the functions of the herein described restraining method. In addition, certain terms are used throughout such as "top", "upper", "lower", "bottom", "lateral", and the like. These terms are used in order to establish an effective frame of reference when referring to the accompanying drawings. These terms, however, should not be regarded as limiting with regard to the intended scope of the present invention, except where specifically indicated.

Figure 1:
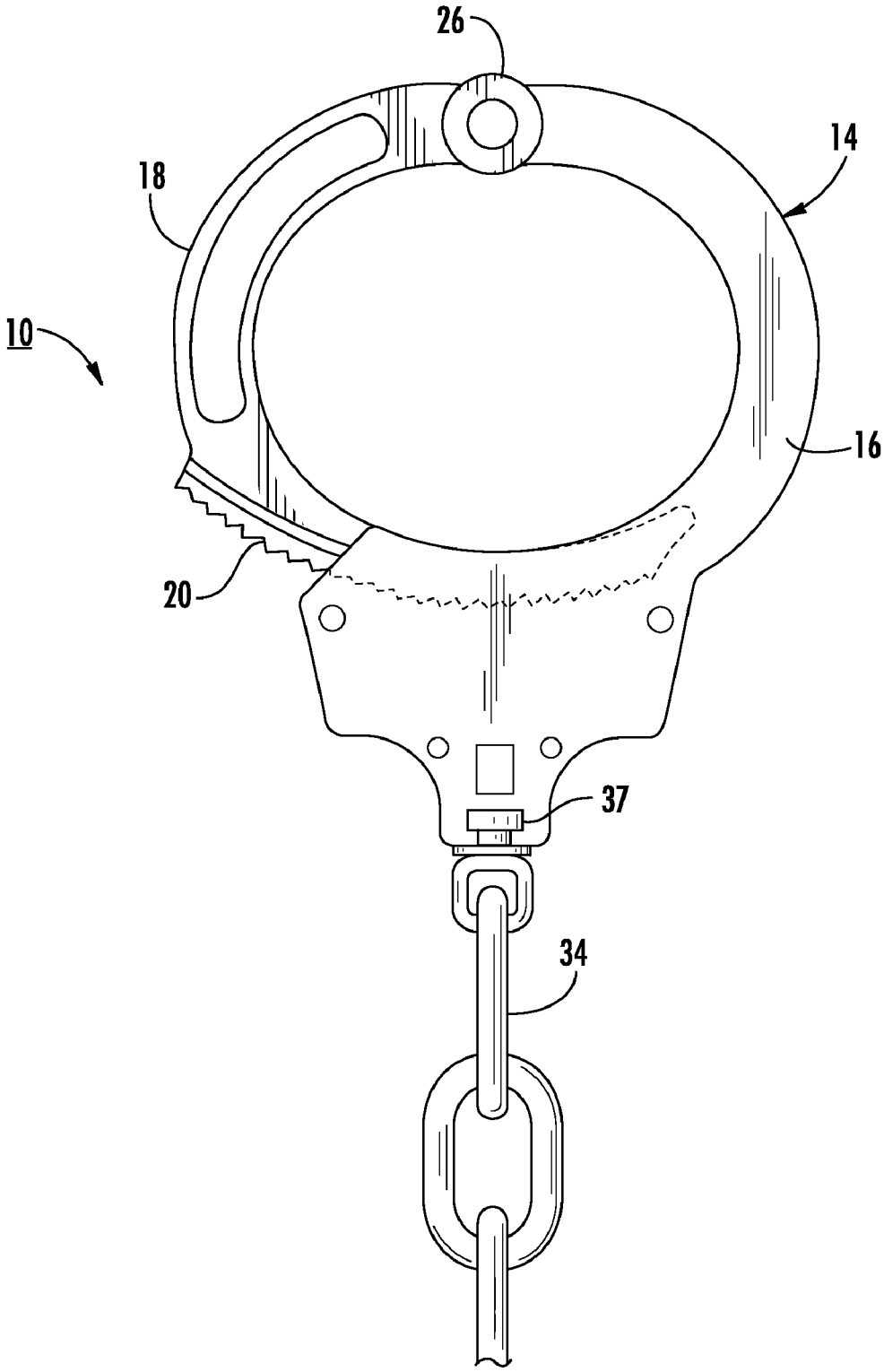
FIG. 1 (PRIOR ART)
FIG. 1 is a partial perspective view, partially in section, of a prior art set of handcuffs.

For purposes of background, reference is first made to FIG. 1 illustrating a prior art set of handcuffs, identified herein as 10. The handcuffs 10 include a pair of respective lockable bracelet or cuff sections, only one of which 14 is shown. Each respective bracelet section 14 includes a cheek member 16 and a jaw member 18, respectively, each of these members being made from stainless steel or similar material and being arcuately shaped.

The jaw member 18 is pivotally attached to the cheek member 16 at a center pivot point 26 so as to permit rotation over a span of 360 degrees thereabout, the bracelet section being defined in a loop-like configuration for adjustably fitting about a person's wrist. The jaw member 18 includes a row of arcuate exteriorly arranged teeth 20 that are aligned to interface with gears (not shown) of a locking mechanism (not shown) that is carried within the interior of the cheek member 16. Additional details concerning the bracelet sections, including the locking mechanism, can be found in U.S. Pat. No. 6,311,529, the entire contents of which are herein incorporated by reference. It should be pointed out, however, that the locking mechanism that is used in connection with the bracelet sections 14 of the handcuffs 10 is not intended to be a novel part of this invention and is noted herein only by way of example. In fact, it is believed that literally any known form of bracelet section locking mechanism can be utilized integrating the handcuff linkage means and/or swivel assembly of the present invention as described below.

Still referring to FIG. 1, the bracelet sections 14 of this known set of handcuffs 10 are separated from one another by a simple fixed chain linkage 34. This linkage 34 includes a pin 37 that is fixedly mounted into the proximal end of the cheek member 16. Due to this linkage, the bracelet sections 14 are not permitted to assume fixed positions relative to one another, whether the handcuffs 10 are placed onto an individual or otherwise.

Figure 2:
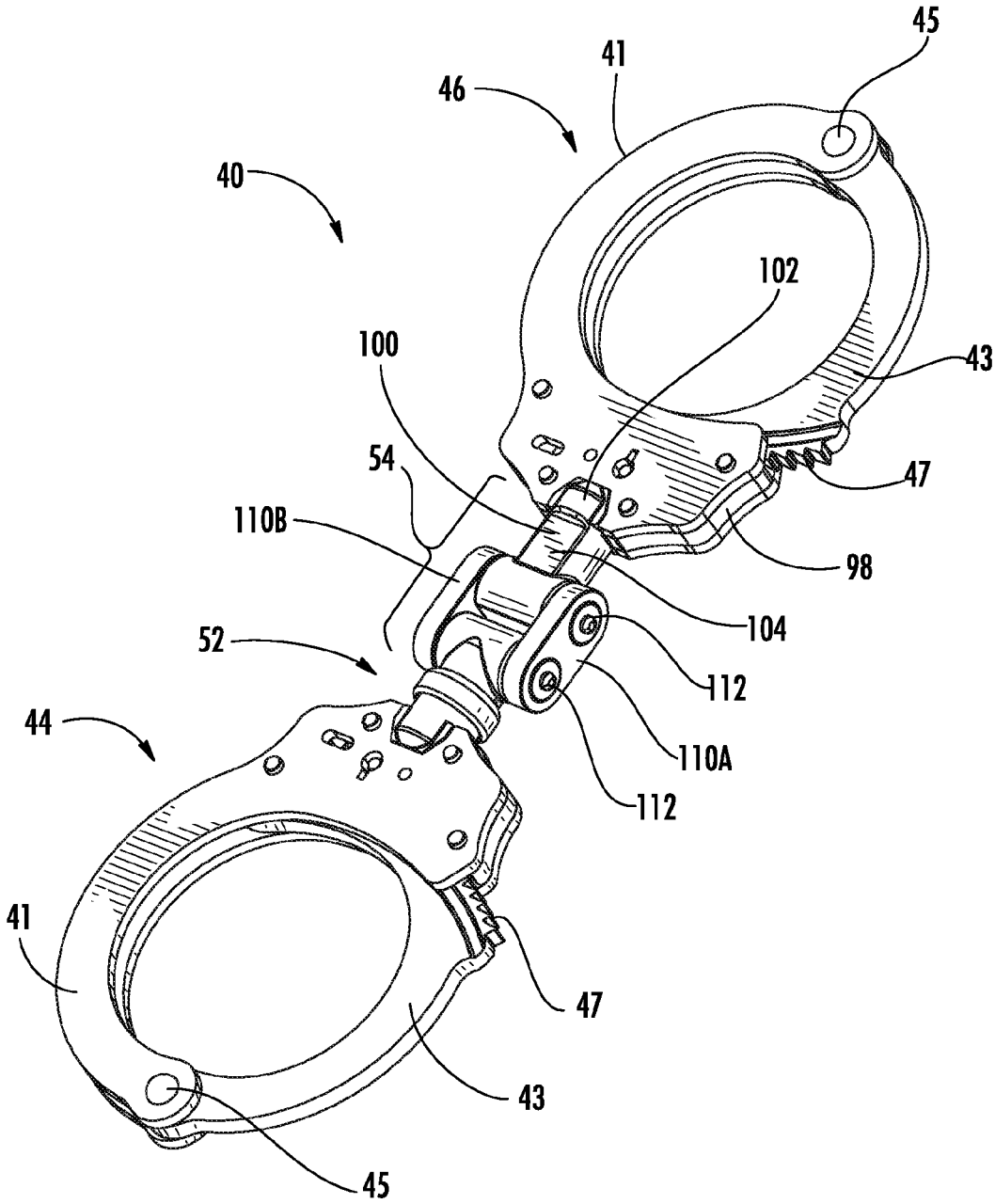
FIG. 2 is a perspective view of a set of handcuffs made in accordance with a preferred embodiment of the present invention.
Figure 3:
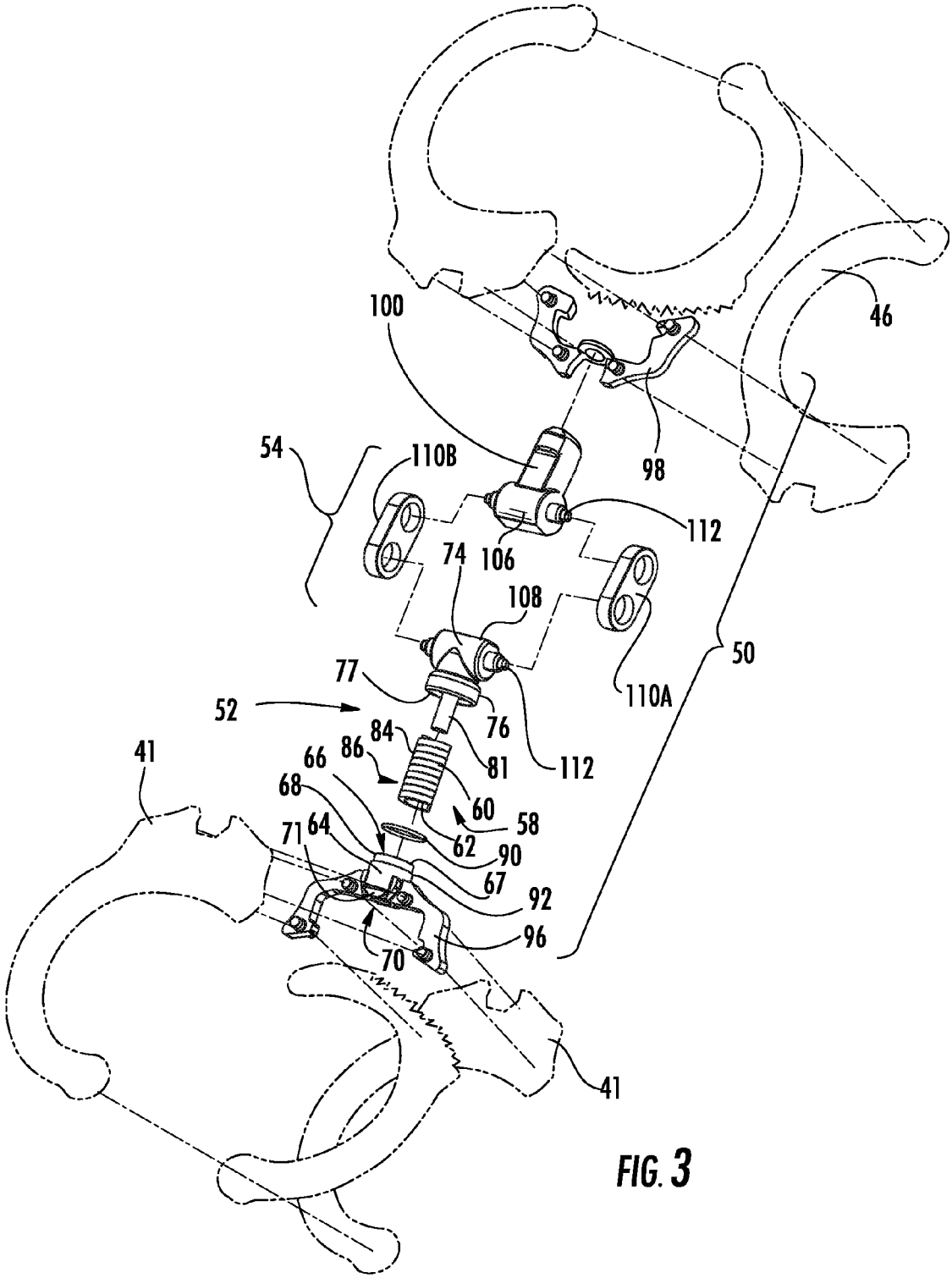
FIG. 3 is an exploded view of the coupling assembly of the handcuffs depicted in FIG. 2.
Figure 4:
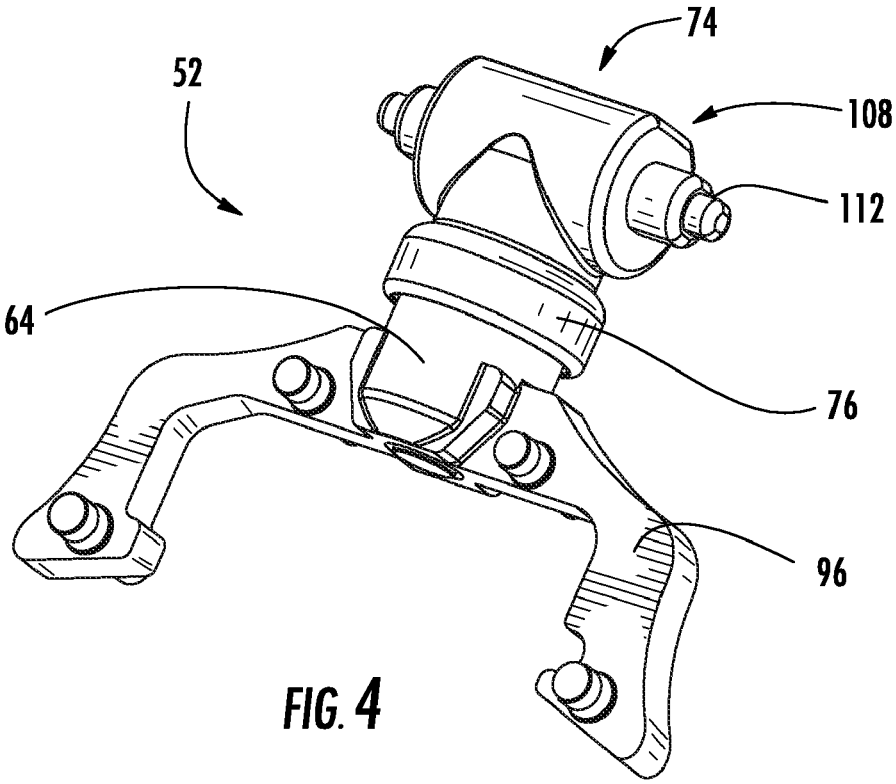
FIG. 4 is an enlarged perspective view of a first embodiment of the unidirectional swivel assembly of the subject invention.
Figure 5:
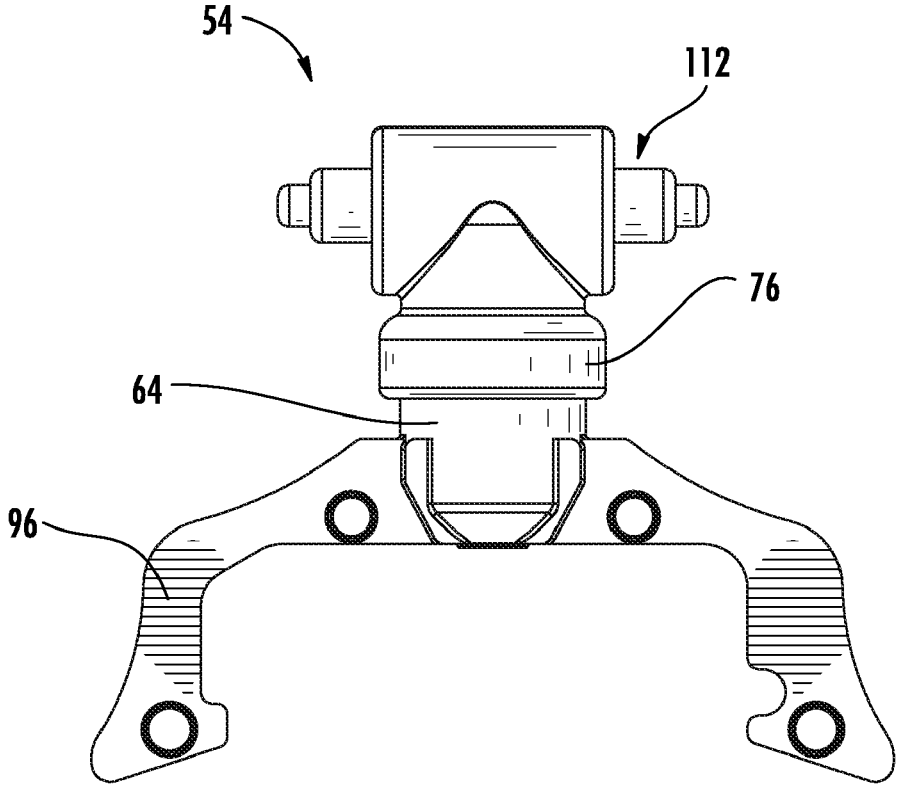
FIG. 5 is frontal view of the swivel assembly of FIG. 4.
Figure 6:
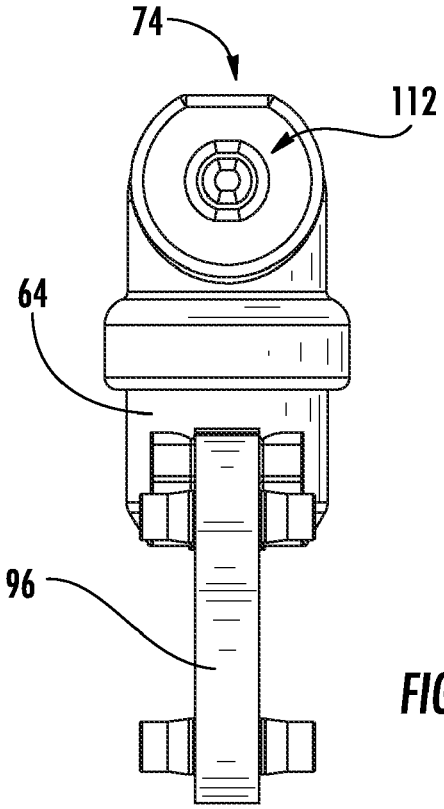
FIG. 6 is a side view of the swivel assembly of FIGS. 4 and 5.
Figure 7:
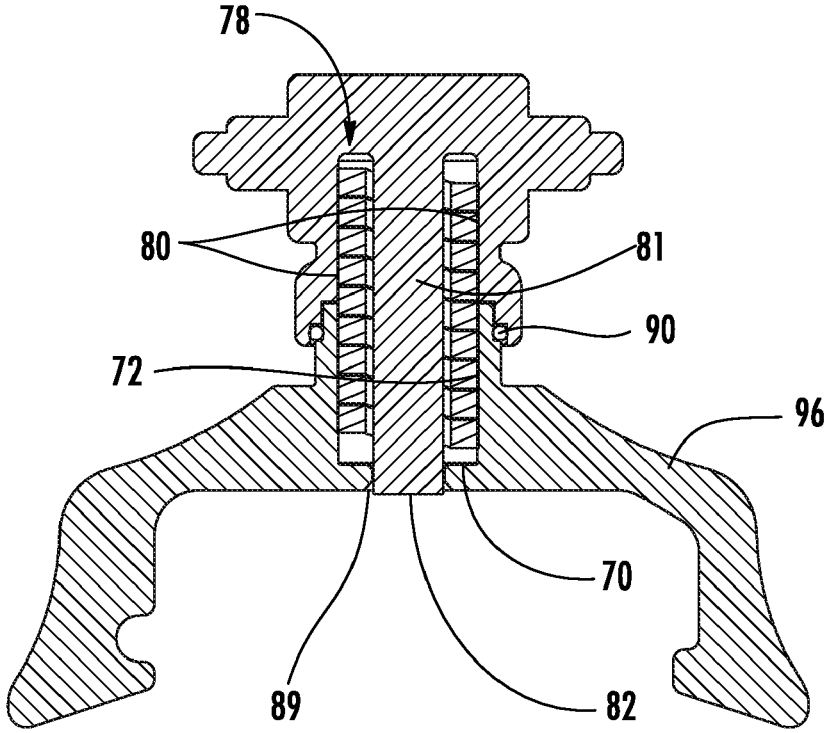
FIG. 7 is a sectional view of the swivel assembly of FIGS. 4-6, taken along line A-A of FIG. 6.

Referring to FIG. 2, there is shown a pair of handcuffs 40 made in accordance with a preferred embodiment of the present invention. Like the preceding, these handcuffs 40 are defined by a pair of matching bracelets, namely first bracelet 44 and second bracelet 46, each of the bracelets including a corresponding cheek member 41 and a jaw member 43. The cheek member 41 and the jaw member 43 are constructed in the manner previously described with regard to the prior art handcuffs 10 of FIG. 1, wherein the jaw member is pivotally attached to cheek member 41 at center pivot point 45 and in which each of first bracelet 44 and second bracelet 46 include a locking mechanism that permits locking engagement between a set of arcuate teeth 47 disposed on a facing surface of the jaw member and locking elements of the locking mechanism (not shown) once one or both of first bracelet and second bracelet have been fitted onto the wrists of a suspect. Thusly constructed, first bracelet 44 and second bracelet 46 are openable, closable and incrementally sizable. As noted above, the locking mechanism of the handcuffs 40 themselves is entirely conventional and does not, in and of itself, form an essential part of the present invention.

With continued reference to FIG. 2, and additional reference to FIGS. 3-7, a bracelet coupling assembly 50 according to the present embodiment is used to couple first and second bracelets 44,46 together, and includes a swivel assembly 52 mounted to first bracelet 44 for permitting angular rotation of at least one of the first bracelet and second bracelet in a predefined first rotational direction (also referred to herein as the "free" direction) to an infinite number of angular positions relative to a longitudinal axis (FIG. 12) extending through swivel assembly 52 and said first and second bracelets 44,46, the swivel assembly 52 preventing the first bracelet 44 and the second bracelet 46 from being rotated in a second rotational direction opposite from the free direction (also referred to herein as the "locking" direction). Coupling means 54 for coupling the swivel assembly and second bracelet together, preferably but not essentially in an articulating manner as herein described, is also provided as described below.

A first preferred embodiment of swivel assembly 52 is comprised of an "outwardly engaging" spring clutch mechanism comprised of: 1) a helical spring 58 having an inner surface 60 and an outer surface 62, 2) a hollowed swivel base 64 having an opening 66 at distal end 67 defined by a collar 68, the opening 66 being in communication with a base chamber defined by a floor 70 of proximal end 71 ("proximal" and "distal" being relative to the bracelet 44 to which swivel assembly 52 is attached) and a cylindrical base chamber wall 72 (FIG. 7), 3) a hollowed swivel head 74 having a skirt 76 defining an opening 77 in communication with a head chamber defined by a ceiling 78 and cylindrical head chamber wall 80, and a centrally disposed coupling stem 81 extending perpendicularly from ceiling 78 a distance below skirt 76 and terminating in journal 82. Base chamber and head chamber together form a single chamber within swivel assembly 52. Union of the base chamber and head chamber is accomplished by the rotational engagement of swivel head 74 and swivel base 64 generally, and of skirt 76 and collar 68, in particular. Journal 82 of coupling stem 81 is seated in an aperture 89 centrally disposed through floor 70 and permanently fixed using a rivet (not shown) or other suitable fastening means to provide axial retention between head and base components without interfering with unidirectional rotation of one about the other. Spring 58, which occupies the chamber of swivel assembly 52, is comprised of swivel head engaging portion 84 and swivel base engaging portion 86, each sized for frictional engagement with head chamber wall 80 and base chamber wall 72, respectively. More specifically, the outer diameter (OD) of spring 58 is slightly larger than the inner diameter (ID) of the chamber to create an interference fit. This interference is typically about 0.005 inches total diameter interference. Swivel base 64 is fixedly attached to or integrally formed with support yoke 96 which in turn is fixedly attached to a proximal end of cheek member 41 of first bracelet 44 by conventional means, such as through welding or by means of suitable fasteners. Alternately, support yoke 96 can be integrated into the design of the bracelet provided adequate clearance has been made relative to a contained bracelet locking mechanism (not shown).

In operation, the outer surface 60 of helical spring 58 is caused to lockingly engage the chamber wall surface formed by the union of swivel head 74 and swivel base 64 when one is rotated relative to the other in a first rotating direction (spring 58 is diametrically deformed, expanding against the wall surface). More specifically, first portion 84 of spring 58 will expand to lockingly engage head chamber wall 80 and second portion 86 of spring 58 will expand to lockingly engage base chamber wall 72 in response to angular rotation of at least one bracelet 44,46 in a predefined first rotational direction relative to an axis 94 extending through bracelets 44,46 and coupling assembly 50. The typical materials and design are intended to support a torque of 300 inch-lbs. This locking engagement restricts further movement of the swivel assembly in the first direction and therefore locks the bracelets, as secured to an individual, from returning to their original or nominal position until the bracelets are opened. The greater the force of rotation (i.e., the harder the detainee attempts to turn the bracelets in the locking direction, the more spring 58 expands and is biased against the interior walls of the chamber. Rotation in the opposite "free" direction is unrestricted; spring 58 will decrease in diameter and allow swivel base 64 and swivel head 74 to swivel about each other with a low torque, typically approximating 5 inch-lbs. An, optional o-ring 90 or other suitable sealing means may be inserted around collar 68 and in abutting engagement with shoulder 92 of distal end 67 of the base member and in abutting engagement with the inner perimeter of skirt 76 to prevent contaminants from affecting the function of swivel assembly 52. In addition, it may be desirable to lubricate spring 58 to provide smooth engagement between contacting surfaces. O-ring 90 can be employed to prevent leakage of the lubricant.

Figure 8:
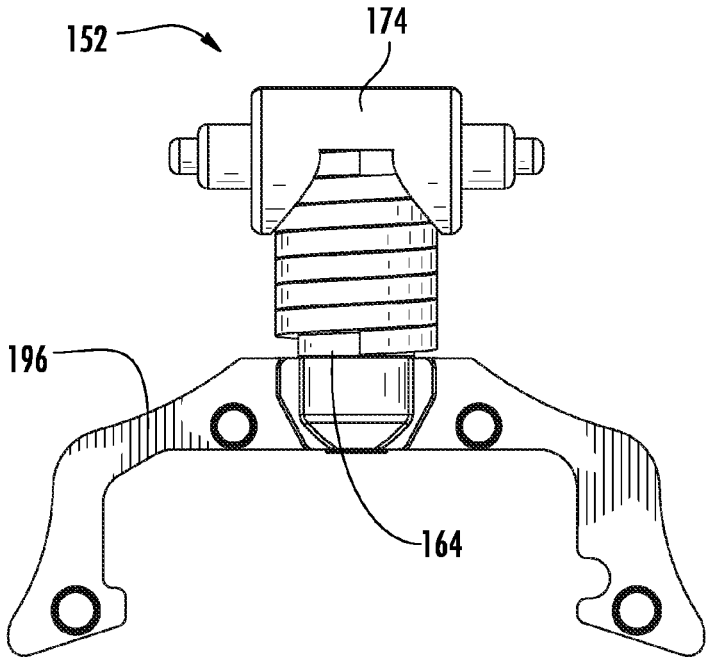
FIGS. 8, 9 and 10 are front, side and sectional views, respectively, of another preferred embodiment of the swivel assembly of the present invention.
Figure 9:
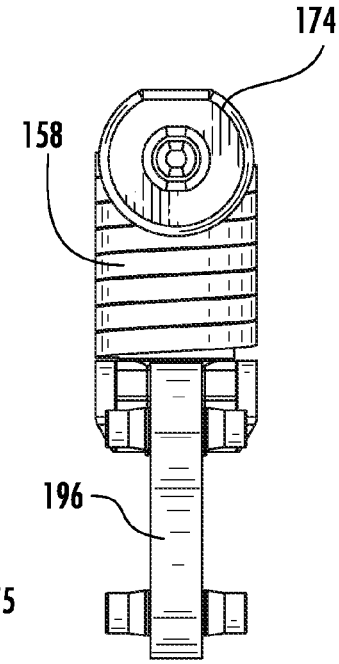
Figure 10:
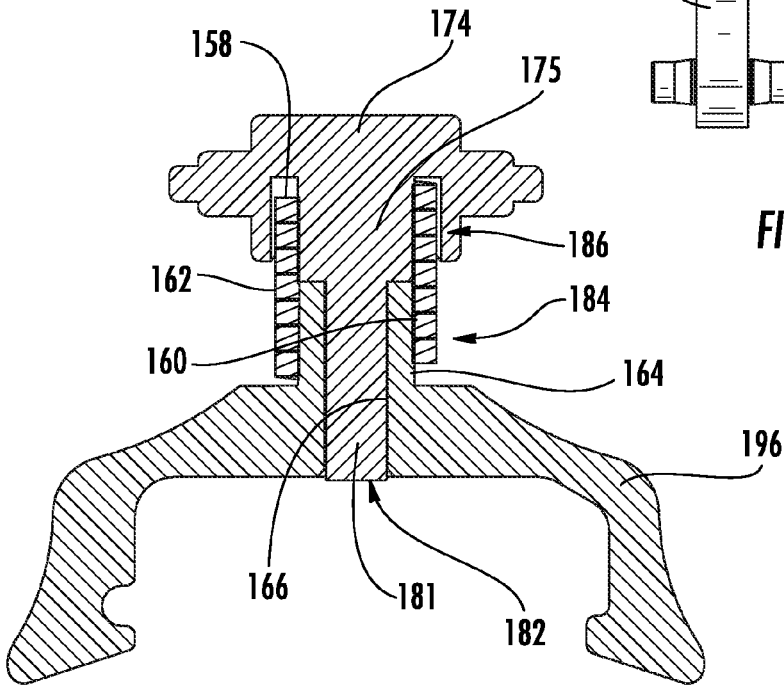

Reference is now made to FIGS. 8-10, in which a second embodiment of the swivel assembly component of the subject apparatus is illustrated. Unlike the above-described embodiment wherein the spring engages the interior walls of the housing, the swivel assembly 152 of this second embodiment may be characterized as an "inwardly engaging" spring clutch mechanism, and is comprised of: 1) a helical spring 158 having an inner surface 160 and an outer surface 162, 2) a base hub 164 having central bore 166 disposed therethrough, and 3) a swivel head 174 having a swivel head hub 175 rotatably mounted to base hub 164 via coupling stem 181 which projects axially from swivel head hub 175 through bore 166. A rivet (not shown) or other suitable means is employed to provide axial retention of coupling stem 181 within bore 166 without interfering with unidirectional rotation of base hub 164 and swivel head hub 175 relative to one another. Spring 158 spans base hub 164 and swivel head hub 175 and is further comprised of base hub engaging portion 184 and swivel head hub engaging portion 186, each being sized for frictional engagement with base and swivel head hubs 164, 175, respectively. More specifically, the inner diameter of spring 158 is slightly smaller than the outer diameter of the hubs to create an interference fit. Here again, this interference is typically about 0.005 inches total diameter interference. Swivel base hub 164 is fixedly attached to or integrally formed with support yoke 196 which in turn is fixedly attached to a proximal end of cheek member 41 of first bracelet 44 by conventional means, such as through welding or by means of suitable fasteners. Alternately, support yoke 196 can be integrated into the design of the bracelet provided adequate clearance has been made relative to a contained bracelet locking mechanism (not shown).

In operation, the inner surface 160 of helical spring 158 is caused to lockingly engage the swivel head hub 175 and base hub 164 when one is rotated relative to the other in a first rotating direction (spring 158 is diametrically deformed, contracting against the surface of each hub). More specifically, first portion 184 of spring 158 will contract to lockingly engage base hub 164 and second portion 186 of spring 158 will contract to lockingly engage swivel head hub 175 in response to angular rotation of at least one bracelet 44,46 in a predefined first rotational direction relative to axis 94. The typical materials and design are intended to support a torque of 300 inch-lbs. This locking engagement restricts further movement of the swivel assembly in the first direction and therefore locks the bracelet sections, as secured to an individual, from returning to their original or nominal position until the bracelet sections are opened. The greater the force of rotation (i.e., the harder the detainee attempts to turn the bracelets in the locking direction, the more spring 158 contracts and grips the hubs. Rotation in the opposite "free" direction is unrestricted; spring 158 will increase in diameter and allow base hub 164 and swivel head hub 175 to swivel about each other with a low torque, typically approximating 5 inch-lbs. It may be desirable to lubricate spring 158 to provide smooth engagement between contacting surfaces. Spring 158 may optionally be surrounded by a housing (not shown) to prevent debris from collecting between the spring and hub interface.

The final primary component of the subject handcuff apparatus, namely coupling means 54, joins swivel assembly 52,152 to second bracelet 46. Referring once again to FIGS. 2 and 3, coupling means 54 is comprised of a connection member 100 having a first end 102 and second end 104. First end 102 is fixedly attached to or integrally formed with second support yoke 98 which in turn is fixedly attached to a proximal end of cheek member 41 of second bracelet 46 by conventional means, such as through welding or by means of suitable fasteners. Alternately, second support yoke 98 can be integrated into the design of the bracelet provided adequate clearance has been made relative to a contained bracelet locking mechanism (not shown). A cylindrical bushing 106 is fixedly mounted to second end 104 of connection member 100 in T-shape fashion. Swivel head 74 is generally cylindrical in shape with the exception of beveled surface 108 extending end-to-end along its longitudinal axis which is perpendicular to axis 94. Swivel head 74 and bushing 106 share in common their general shape, lengths and diameters and are oriented in side-by-side fashion with the longitudinal axis of bushing 106 being parallel to that of swivel head 74. Swivel head 74 and bushing 106 are interconnected by a pair of oblong links 110A and 110B, each being pivotally mounted to the ends of swivel head 74 and bushing 106 to form a linkage similar in construction to a portion of a'bicycle chain drive. A variety of fastening means 112 may be employed for coupling each link 110A,B to swivel head 74 and bushing 106 in a manner well known to those skilled in the art.

Figure 11:
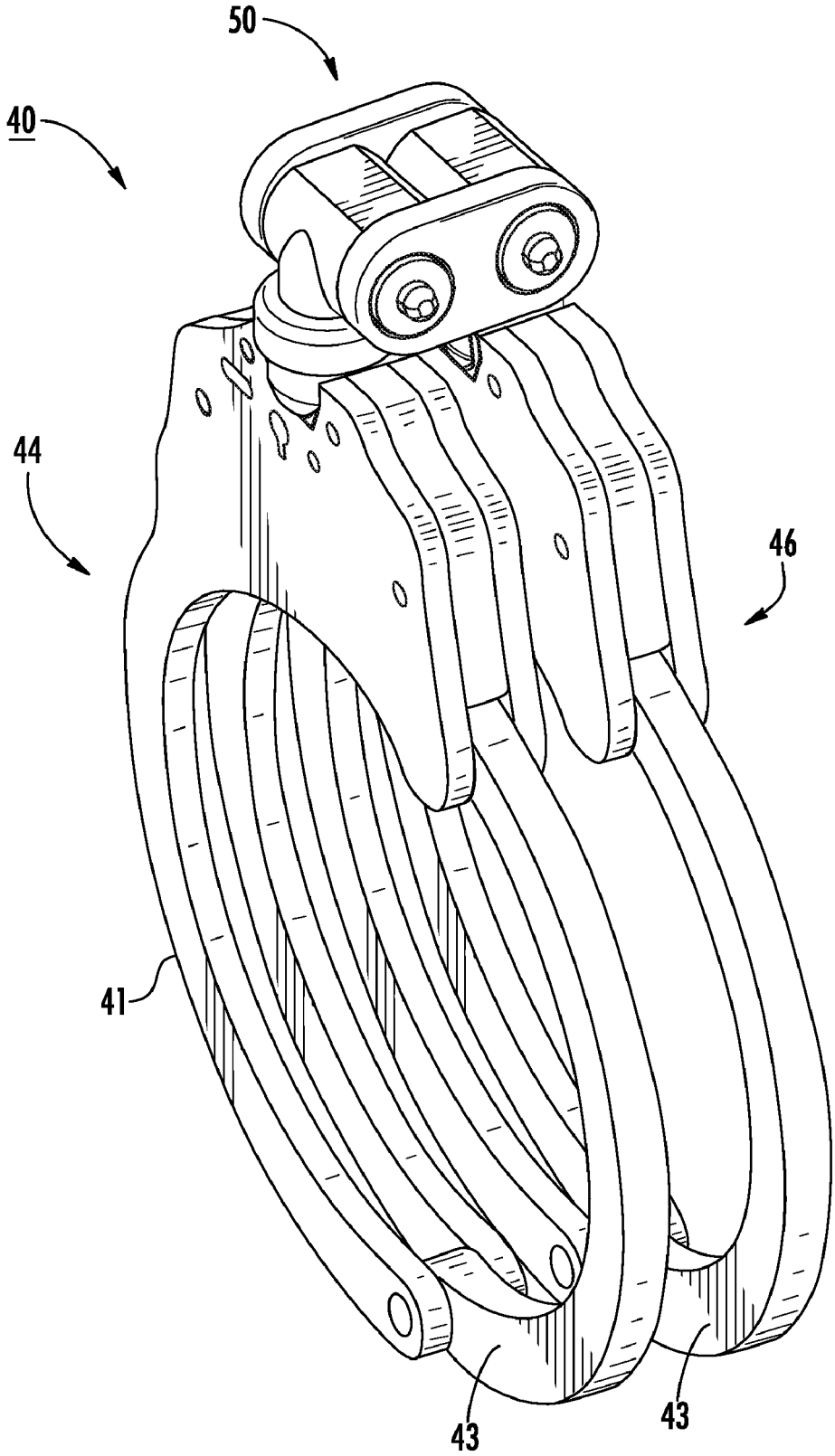
FIG. 11 is an isometric view of the handcuffs of FIGS. 2-7 as shown in a folded or storage position.

As is shown in FIG. 11 and due to the articulating nature of coupling assembly 50 generally, and coupling means 54 in particular, first and second bracelets 44,46 of handcuffs 40 can be folded one on top of the other in a conventional manner for storage and therefore can be used with known handcuff holders (not shown). Moreover, the coupling assembly 50 herein described does not add significant size or weight to the handcuffs 40 as compared to already existing handcuffs. Therefore, incorporation of the above coupling assembly, including the swivel assembly 52 and coupling means 54 does not significantly interfere with the typical operation or design of known handcuffs.

Note that in the above-described embodiments of the subject invention, swivel assembly 52 (or 152) is fixedly mounted or attached at one end to a bracelet 44 while the opposite end of swivel assembly 52 (152) is attached to the second bracelet 46 via the above described coupling means to permit folding of the bracelets one atop of the other. It should be readily appreciated, however, that alternate coupling means and arrangement of components may be employed to achieve the desired foldability. For instance, rather than the "bracelet/swivel/coupling means/bracelet" configuration described, the swivel assembly could be pivotally mounted to each bracelet 44,46 via coupling means in a "bracelet/coupling means/swivel/coupling means/bracelet" configuration. Additionally, those skilled in the art will readily recognize that the permitted direction of rotation of a bracelet about axis 94 is determined by the direction of turn of spring 58, namely whether spring 58 has a right hand or a left hand turn. Turning in a direction against the turn of spring 58 will result in outward diametric deformation of the spring (outwardly engaging); turning in a direction with the turn of spring 58 will result in inward diametric deformation of the spring (inwardly engaging).

Figure 12:
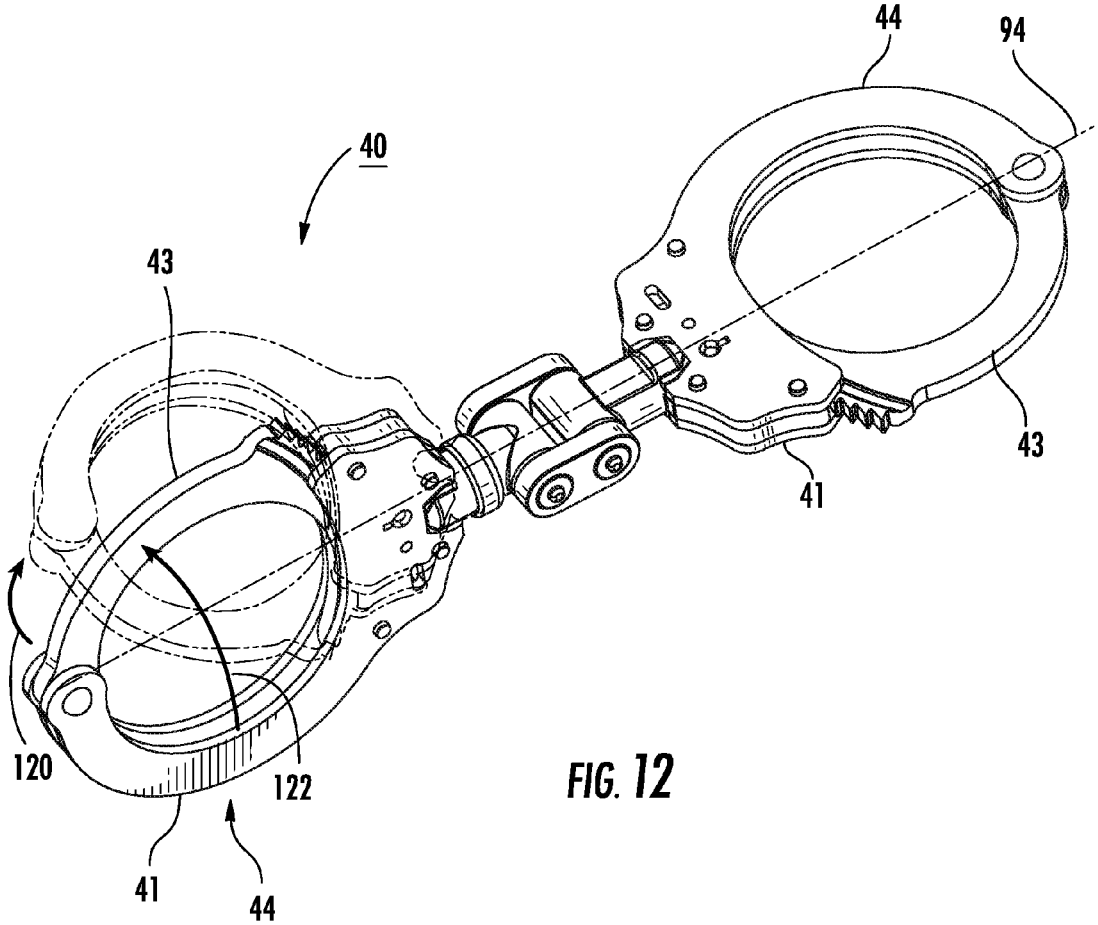
FIG. 12 is a top perspective view of the handcuffs of FIGS. 2-7 illustrating the rotatability of the bracelet sections in accordance with the present invention.

Referring to FIGS. 12-15 and having described the basic features of the handcuffs 40, the operation of the coupling assembly 50 will be illustratively described. As shown in FIG. 12, it can be seen that first bracelet section 44 is entirely rotatable about axis 94 to an infinite number of angular positions. Once rotated to any angular position in the free direction 120, the first bracelet 44 cannot be rotated back to its original or nominal position due to the above spring clutch action, thereby preventing any movement in the opposite locking direction, shown as 122. It should appreciated that although first bracelet 44 is described immediately above as the bracelet being rotated, in actual use of the subject handcuffs 40, the bracelets both rotate relative to one another. It should also be appreciated that the direction of permissible rotation is determined by the direction of coil of helical spring 58,158.

Figure 14:
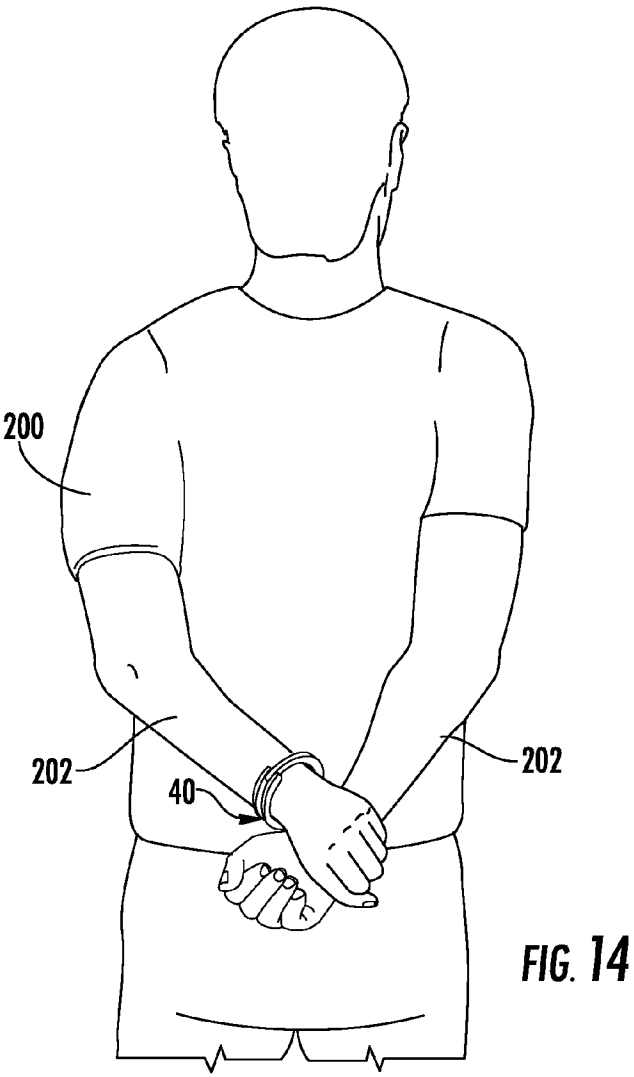
FIGS. 13, 14 and 15 are rear elevation views of a person restrained by the subject handcuffs, these views illustrating respective arm positions as a bracelet section is placed in a nominal position, a 90 degree position, and an 180 degree position in accordance with the method of the restraining present invention.
Figure 13:
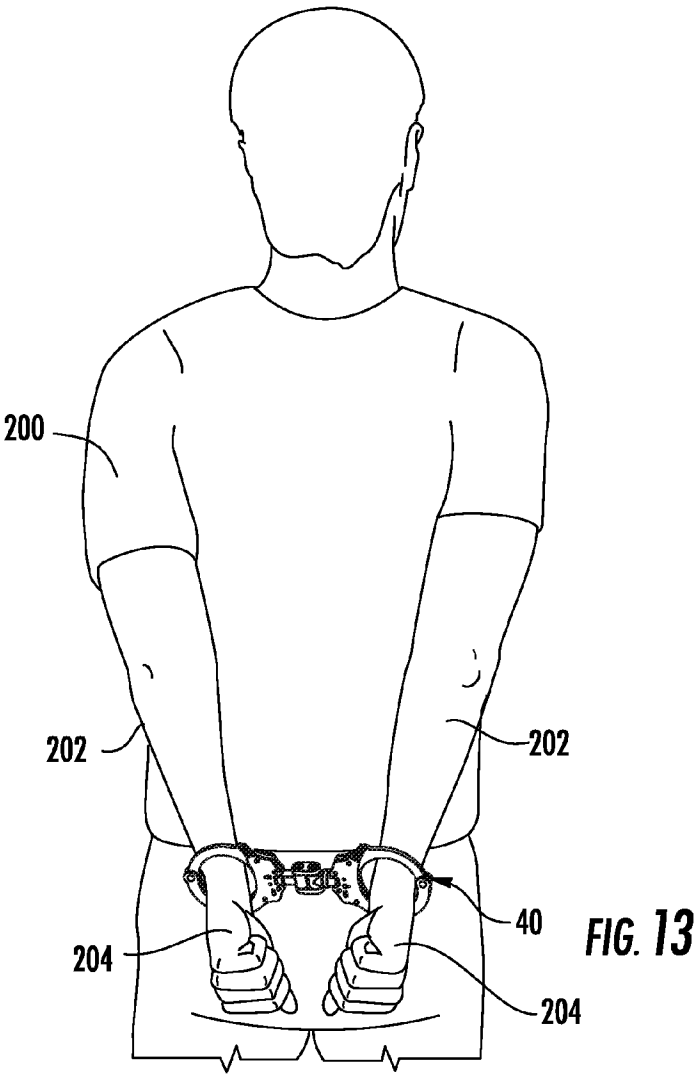
Figure 15:
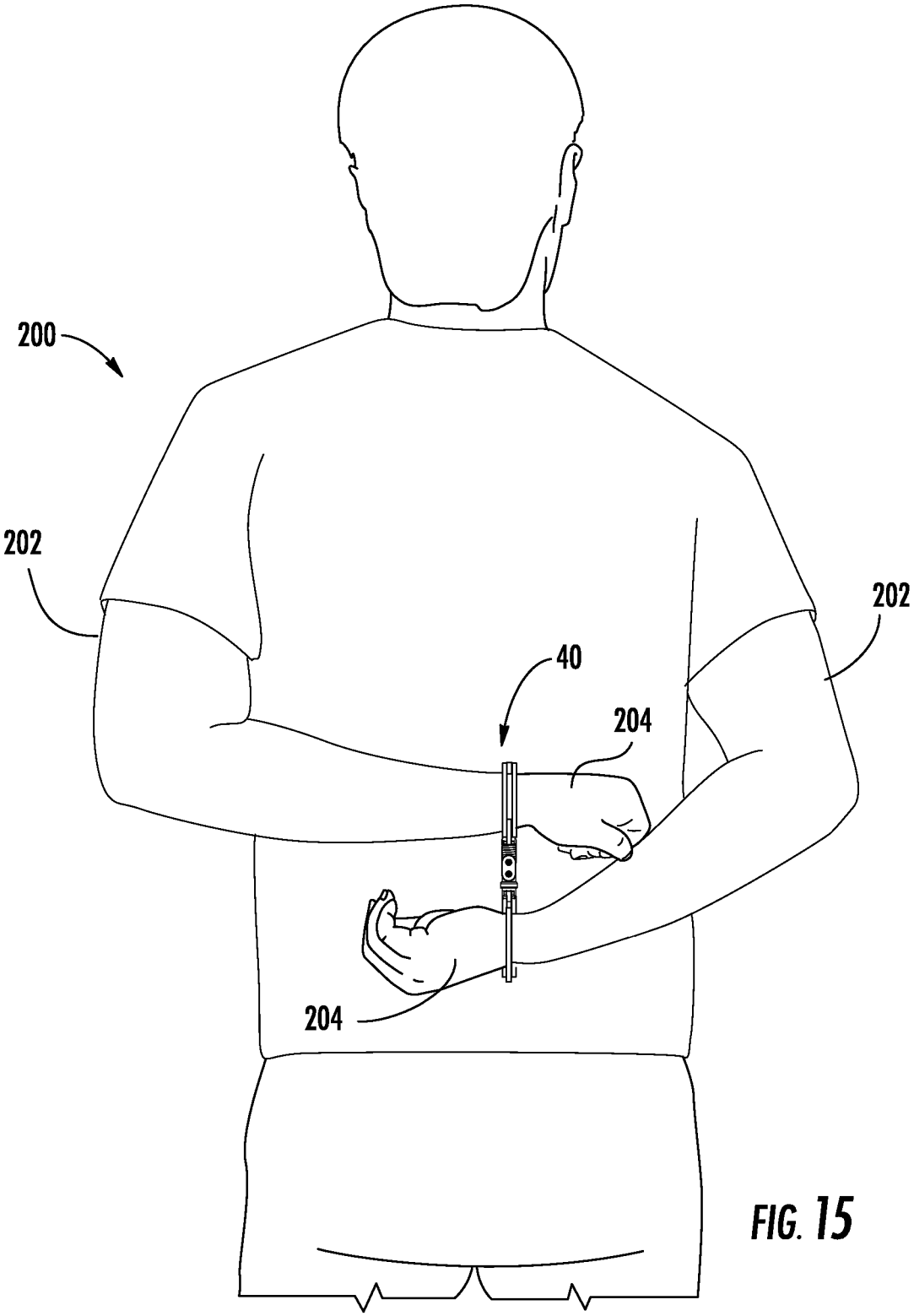

The overall effect of the above mechanism to a person who has been handcuffed is shown by way of example in FIGS. 13-15. FIG. 13 illustrates an individual or detainee 200 who has been handcuffed from behind, such that the handcuffs 40 are attached at each wrist in an ordinary or "nominal" position with each bracelet occupying the same plane. In this position, the palms 204 of the hands of the detainee 200 face one another and the arms 202 are generally in a vertical attitude.

FIG. 14 illustrates a first locked position that is assumed when first bracelet 44 has been rotated to a first angular position, in this instance approximately 90.degrees from normal. This position can be achieved by rotating either of the cuffed arms 202 in the free rotational direction. It should be readily apparent that other positions could have been selected. In this position, the arms 108 are pulled from the vertical attitude and are caused to fold at the elbows. Because of the unidirectional nature of the swivel assembly 52, the individual 200 cannot rotate either his hands or the handcuffs 40 back to the original position depicted in FIG. 13.

A further rotational position is illustrated in FIG. 15 wherein the bracelet section has now been rotated 180 degrees (that is, an additional 90 degrees from the position of FIG. 14) relative to the original or nominal position shown in FIG. 13. In this position, the arms 202 are additionally rotated until the arms are crossed one above the other with the palms 204 still facing one another, the detainee 200 now being in a much more secure position than the nominal position of FIG. 13. As a result and from this position, which cannot be achieved with conventional handcuffs, the handcuffed individual cannot "step-through" the handcuffs 40, thereby posing less of a threat to a law enforcement officer. Moreover, the positioning of the arms 202 behind the back, as depicted in FIGS. 14 and 15, is in fact more comfortable for the detainee 200 than the position shown in FIG. 13. It should be readily apparent that alternate or intermediate positions can be assumed, depending on the degree of rotation of first bracelet 44. It should be pointed out that a similar scenario would apply to a detainee who has been cuffed from the front, meaning that the detainee's arms would be caused to similarly fold as first bracelet 44 is rotated in the manner previously described.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A coupling assembly for coupling a first handcuff bracelet and a second handcuff bracelet together, each bracelet including a locking mechanism for opening and closing the bracelet, the coupling assembly comprising: a swivel assembly for permitting angular rotation of at least one of the bracelets in a predetermined first rotational direction relative to a longitudinal axis extending through said swivel assembly and the first and second bracelets, said swivel assembly preventing the bracelets from being rotated in a second rotational direction opposite from said first rotational direction; said swivel assembly comprising a swivel base attached directly or indirectly to the first bracelet; a swivel head rotatably mounted to said swivel base and attached via coupling means to the second bracelet; a spring having a swivel base engaging portion in frictional engagement with said swivel base, and a swivel head engaging portion in frictional engagement with said swivel head; whereby rotation of the first bracelet in said second direction results in diametric deformation of said spring causing said swivel base engaging portion to lockingly engage said swivel base, and said swivel head engaging portion to lockingly engage said swivel head.

2. A coupling assembly as recited in claim 1, herein said rotation may be to an infinite number of angular positions relative to said axis.

3. A coupling assembly as recited in claim 2, wherein said coupling means includes means for permitting the first bracelet and the second bracelet to be folded onto one another for storage.

4. A coupling assembly as recited in claim 1, wherein said coupling means includes means for permitting the first bracelet and the second bracelet to be folded onto one another for storage.

5. A coupling assembly for coupling a first handcuff bracelet and a second handcuff bracelet together, each bracelet including a locking mechanism for opening and closing the bracelet, the coupling assembly comprising: a swivel assembly for permitting angular nation of at least one of the bracelets in a predetermined first rotational direction relative to a longitudinal axis extending through said swivel assembly and the first and second bracelets, said swivel assembly preventing the bracelets from being rotated in a second rotational direction opposite from said first rotational direction; said swivel assembly comprising a base hub attached directly or indirectly to the first bracelet; a swivel head attached via coupling means to the second bracelet, said swivel head having a head hub rotatably mounted to said base hub; a spring having a base hub engaging portion in frictional engagement with said base hub, and ahead hub, engaging portion in frictional engagement with said head hub; whereby rotation of said first bracelet in said second direction results in diametric deformation of said spring causing said base hub engaging portion to lockingly engage said base hub, and said head hub engaging portion to lockingly engage said head hub.

6. A coupling assembly as recited in claim 5, herein said rotation may be to an infinite number of angular positions relative to said axis.

7. A coupling assembly as recited in claim 6, wherein said coupling means includes means for permitting the first bracelet and the second bracelet to be folded onto one another for storage.

8. A coupling assembly as recited in claim 5, wherein said coupling means includes means for permitting the first bracelet and the second bracelet to be folded onto one another for storage.

9. A set of handcuffs comprising: a first bracelet and a second t, each including a locking mechanism for opening and closing said bracelet; and a coupling assembly for coupling said first bracelet and said second bracelet together; said coupling assembly including a swivel assembly for permitting angular rotation of at least one of said first bracelet and said second bracelet in a predetermined first rotational direction relative to a longitudinal axis extending through said swivel assembly and said first and second bracelets, said swivel assembly preventing said at least one of said first bracelet and said second bracelet from being rotated in a second rotational direction opposite from said first rotational direction; said swivel assembly including a swivel base attached directly or indirectly to said first bracelet; a swivel head rotatably mounted to said swivel base and attached via coupling means to said second bracelet; a spring, having a swivel base engaging portion in frictional engagement with said swivel base, and a swivel head engaging portion in frictional engagement with said swivel head; whereby rotation of said first bracelet in said second direction results in diametric deformation of said spring causing said swivel base engaging portion to lockingly engage said swivel base, and said swivel head engaging portion to lockingly engage said swivel head, thereby preventing further rotation in said second direction while permitting rotation in said first direction.

10. A set of handcuffs as recited in clam 9, wherein at least one of said first bracelet and said second bracelet can be rotated in only one direction relative to said axis.

11. A set of handcuffs as recited in claim 10, wherein said rotation may be to an infinite number of angular positions relative to said axis.

12. A set of handcuffs as recited in claim 11, wherein said coupling means includes means for permitting said first bracelet and said second bracelet to be folded onto one another for storage.

13. A set of handcuffs as recited in claim 10, wherein said coupling means includes means or permitting said first bracelet and said second bracelet to be folded onto one another storage.

14. A set of handcuffs as recited in claim 9, wherein said coupling means includes means for permitting said first bracelet and said second bracelet to be folded onto one another for storage.

15. A set of handcuffs comprising: a first bracelet and a second bracelet, each including a locking mechanism for opening and closing said bracelet; and a coupling assembly for coupling said first bracelet and said second bracelet together; said coupling assembly including a swivel assembly for permitting angular rotation of at least one of said first bracelet and said second bracelet in a predetermined first rotational direction relative to a longitudinal axis extending through said swivel assembly and said first and second bracelets, said swivel assembly preventing said at least one of said first bracelet and said second bracelet from being rotated in a second rotational direction opposite from said first rotational direction; said swivel assembly including a base hub attached directly or indirectly to said first bracelet; a swivel head attached via coupling means to said second bracelet, said swivel head having a head hub rotatably mounted to said base hub; a spring having a base hub engaging portion in frictional engagement with said base hub, and a head hub engaging portion in frictional engagement with said head hub; whereby rotation of said first bracelet in said second direction results in diametric clef ion of said spring causing said base hub engaging portion to lockingly engage said base hub, and said head hub engaging portion to lockingly engage said head hub, thereby preventing further rotation in said second direction white permitting rotation in said first direction.

16. A set of handcuffs as recited in claim 15, wherein at least one of said first bracelet and said second bracelet can be rotated in only one direction relative to said axis.

17. A set of handcuffs as recited in claim 16, wherein said rotation may be to an in number of angular positions relative to said axis.

18. A set of handcuffs as recited in claim 17, wherein said coupling means includes means for permitting said first bracelet and said second bracelet to be folded onto one another for storage.

19. A set of handcuffs as recited claim 16, wherein said coupling means includes means for permitting said first bracelet and said second bracelet to be folded onto one another for storage.

20. A set of handcuffs as recited in claim 15, wherein said coupling mean includes means for permitting said first bracelet and said second bracelet to be folded onto one another for storage.

* * * * *